US007306102B2

(12) United States Patent
Chang

(10) Patent No.: US 7,306,102 B2
(45) Date of Patent: Dec. 11, 2007

(54) DIMENSION ADJUSTABLE SHOCK-ABSORBING PACKAGE STRUCTURE

(75) Inventor: Pi-Chun Chang, TaoYuan Hsien (TW)

(73) Assignee: BENQ Corporation, Taoyuan (TW)

( * ) Notice: Subject to any disclaimer, the term of this patent is extended or adjusted under 35 U.S.C. 154(b) by 355 days.

(21) Appl. No.: 11/076,508

(22) Filed: Mar. 9, 2005

(65) Prior Publication Data

US 2005/0199528 A1 Sep. 15, 2005

(30) Foreign Application Priority Data

Mar. 12, 2004 (TW) ..... 93203812 U

(51) Int. Cl.
*B65D 81/02* (2006.01)
*B65D 85/30* (2006.01)

(52) U.S. Cl. ..... 206/523; 206/588; 206/591

(58) Field of Classification Search ..... 206/523, 206/588, 591, 592

See application file for complete search history.

(56) References Cited

U.S. PATENT DOCUMENTS

| | | | | | |
|---|---|---|---|---|---|
| 2,860,768 | A | * | 11/1958 | Smithers | 206/523 |
| 2,956,687 | A | * | 10/1960 | Robichaud | 206/523 |
| 3,292,778 | A | * | 12/1966 | Enderle | 206/523 |
| 4,840,277 | A | * | 6/1989 | Waldner | 206/523 |
| 5,207,327 | A | * | 5/1993 | Brondos | 206/523 |
| 6,499,599 | B1 | * | 12/2002 | Hopkins et al. | 206/523 |

FOREIGN PATENT DOCUMENTS

JP 52-4395 * 1/1977

* cited by examiner

*Primary Examiner*—Bryon P Gehman
(74) *Attorney, Agent, or Firm*—Ladas and Parry LLP

(57) ABSTRACT

A shock-absorbing package structure comprising a frame and a shock-absorbing rib is provided. The frame forms an inner space to accommodate a component. The shock-absorbing rib extending from the frame toward the inner space has two cuts for folding the shock-absorbing rib to adjust the dimension of the inner space according to the shape of the component.

14 Claims, 7 Drawing Sheets

DIMENSION ADJUSTABLE SHOCK-ABSORBING PACKAGE STRUCTURE

BACKGROUND OF THE INVENTION (1) Field of the Invention

The invention relates to a shock-absorbing package structure, and more particularly to the package structure with an adjustable inner space so as to accommodate components with different dimensions.

(2) Description of the Prior Art

It is an important event for electronic products to be properly packaged to avoid collision or damage during shipment. To achieve this purpose, a shock-absorbing package material is usually used encircling the electronic products for providing sufficient protection so as to prevent the electronic products from functional and appearance damages.

The most widely used shock-absorbing package materials nowadays are polystyrene (EPS), expanded polythene (EPE), and paper. EPE is made from foamed polythene (PE) and has isolated bubble structures to present the advantages of lightweight, flexibility, shock-absorbing ability, and so on. In contrast with EPS, which is made from foamed polystyrene (PS), EPE has a better flexibility allowing bending to any specific angle without breakup. In contrast with paper material, which needs a specific structural design for provide shock-absorbing event, EPE has excellent shock-absorbing ability itself. That is, an EPE package needs a lower fabrication cost compared with a paper package. In addition, due to the characteristics of PE, EPE also present the advantages of chemical damage resistant, heat-resistant, water-proof, and dust-proof.

EPE material can be properly shaped by injection molding according to the shape of the components to be packed. In addition, the injection molded EPE plates can be further shaped by cutting and adhered to form a three-dimensional shock-absorbing package structure.

FIG. 1 shows a perspective view of a typical EPE shock-absorbing package structure 100. The shock-absorbing package structure 100 is formed of two pieces of boards 120 and 140 adhered to each other. The inner board 120 is provided with a space 122 used to accommodate the component to be packed. The outer board 140 faces to a side surface of the component (not shown) for shock-absorbing event. Referring to FIG. 2, a pair of package structures 100 shown in FIG. 1 are assembled to the left side and right side of the component 200 to be packed relatively. In addition, also referring to FIG. 1, by assembling the component to the inner space 122 of the inner board 120, a proper buffer space around the upper, lower, front and rear surfaces of the component is provided to prevent the collision and damage from all directions.

It is noted that the shock-absorbing package structure must tightly enclose the packed component otherwise the packed component cannot be effectively protected. As a result, in order to match a variety of components with different dimensions, various shock-absorbing package structures with different dimensions are also required. However, the fabrication of the shock-absorbing package structures with different dimensions needs a variety of molding structure, which leads to a tremendous investment.

Furthermore, the mentioned shock-absorbing boards must have enough thickness to provide sufficient buffer distance. In addition, as shown in FIG. 1, the traditional shock-absorbing package structure requires a plurality of pieces of boards to provide proper shock-absorbing protection. Thus, a large amount of storing space is demanded for such shock-absorbing package structures due to the above mentioned factors.

Accordingly, as the types of shapes of electronic components continuously increasing, how to reduce the sorts of the shock-absorbing package structures to decrease the cost of molding apparatus and the storage space has become a major consideration for packaging industry.

SUMMARY OF THE INVENTION

It is a main object of the present invention to provide a shock-absorbing package structure applicable to the components with different dimensions so as to reduce the cost of various molding apparatuses.

It is another object of the present invention to provide a package structure requires a reduced storage space and still maintains excellent shock-absorbing protection.

The shock-absorbing package structure in accordance with the present invention includes a frame and a shock-absorbing rib. The frame is provided with an inner space used to accommodate a component. The shock-absorbing rib is extended from the frame toward the inner space, and also has two cuts helpful for folding the shock-absorbing rib, thereby the dimension of the inner space can be adjusted according to the dimension of the component.

In one embodiment of the present invention, there is a cut located at the root of the shock-absorbing rib, and a folding along the cut may lead to a maximum inner space for accommodating the component.

As most components are rectangular in shape, in the embodiments of the present invention, an rectangular inner space is provided in the frame. In addition, the shock-absorbing rib is perpendicular to the connected sidewall of the frame. The two cuts are vertical to the extending direction of the shock-absorbing rib.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
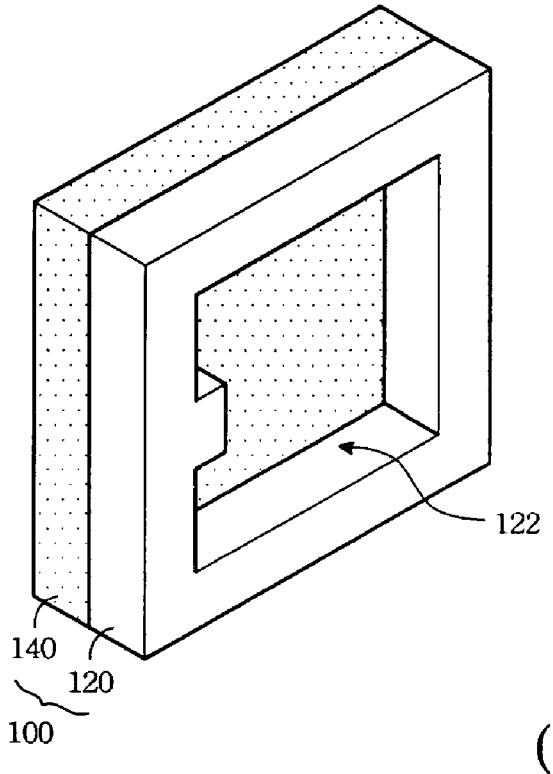
FIG. 1 (Prior Art)
FIG. 1 is a schematic view depicting a traditional EPE shock-absorbing package structure.
Figure 2:
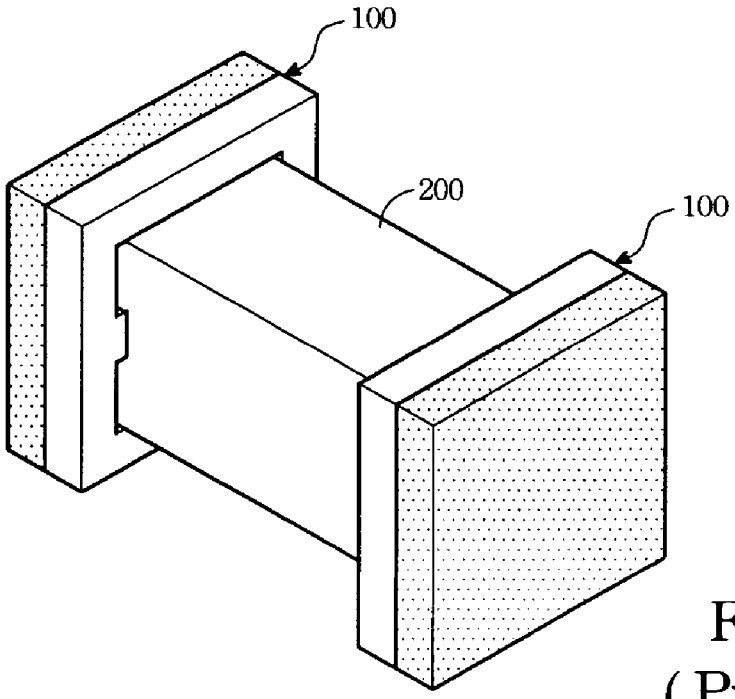
FIG. 2 (Prior Art)
FIG. 2 is a schematic view depicting a component is packed by a pair of traditional shock-absorbing package structure of FIG. 1.
Figure 3A:
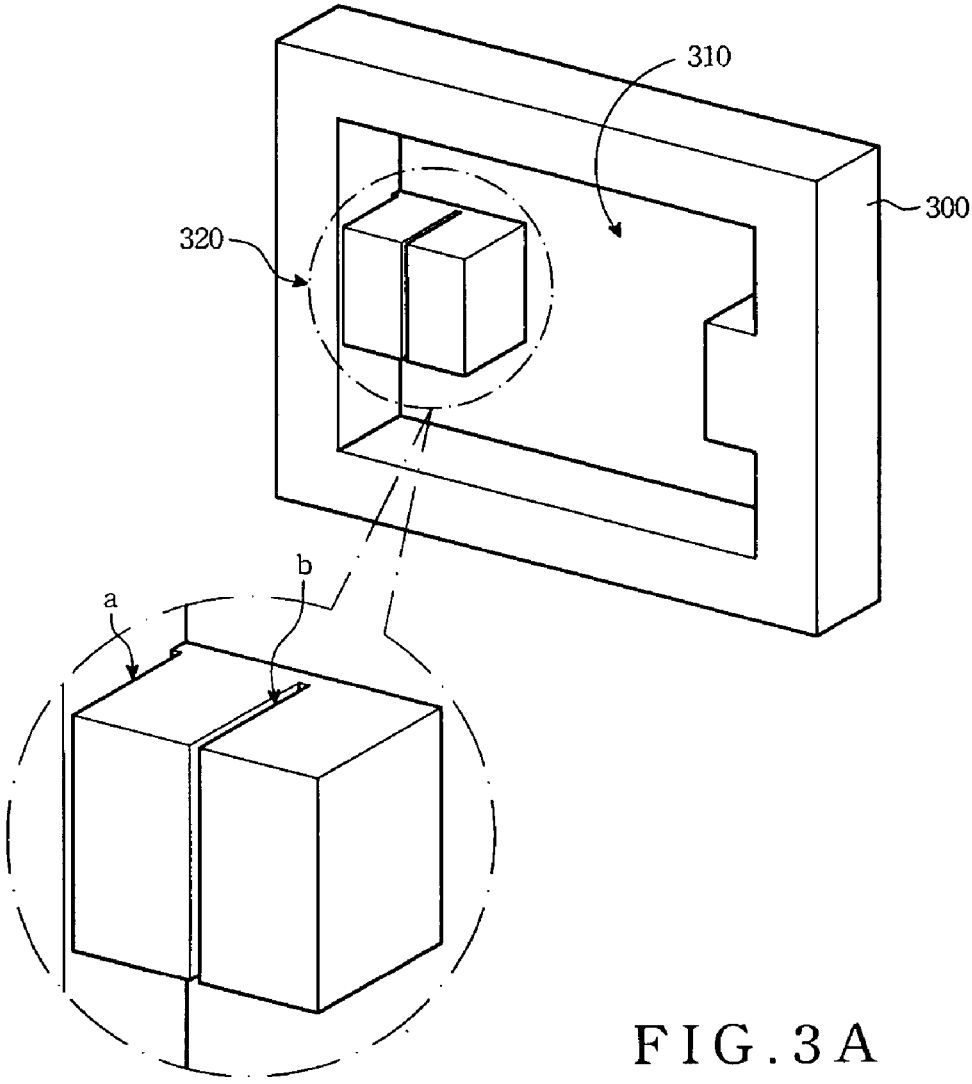
FIG. 3A is a schematic view depicting a first preferred embodiment of the shock-absorbing package structure in accordance with the present invention.

FIG. 3A shows a schematic view of a first preferred embodiment of a shock-absorbing package structure in accordance with the present invention. As most components are rectangular in shape, there is rectangular inner space 310 formed in a frame 300 of the shock-absorbing package structure to accommodate a rectangular shaped component. Further, there is a shock-absorbing rib 320, formed on a sidewall of frame 300 and extending into the inner space 310. In addition, there are two cuts a and b formed on the shock-absorbing rib 320 facilitate the folding of the shock-absorbing rib 320.

Figure 3B:
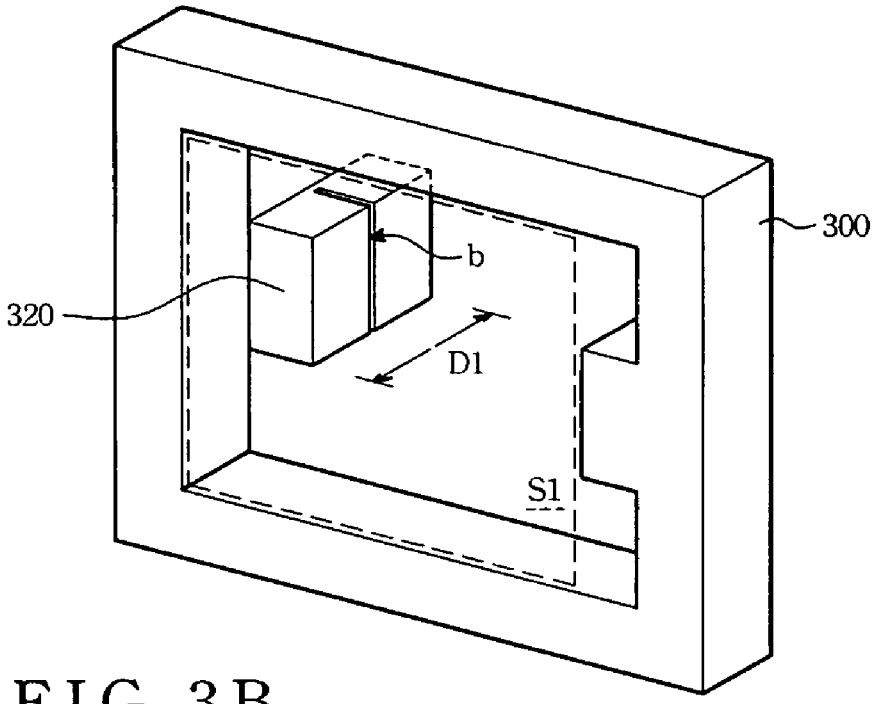
FIG. 3B is a schematic view depicting the shock-absorbing package structure of FIG. 3A, as the shock-absorbing rib a has been folded.
Figure 3C:
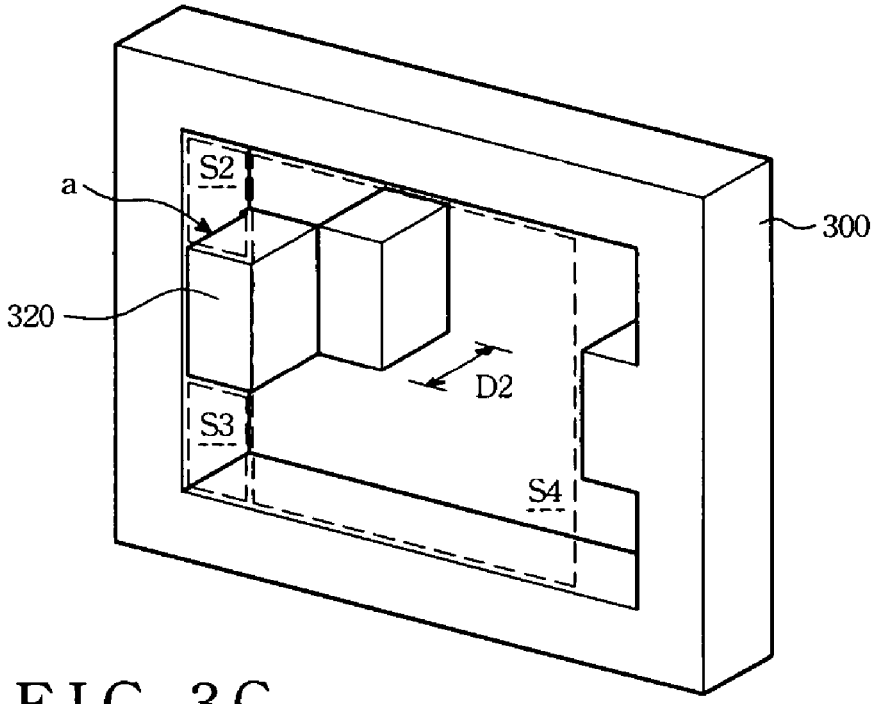
FIG. 3C is a schematic view depicting the shock-absorbing package structure of FIG. 3A, as the shock-absorbing rib b has been folded.

Referring to FIG. 3B, when a larger shock-absorbing distance D1 is required for long distance shipment, users can fold the shock-absorbing rib 320 outward by applying force along the cut a at the root of the shock-absorbing rib 320. Meanwhile, the package structure presents a largest inner space S1 in the frame 300, which is encircled by the dotted line shown in FIG. 3B to accommodate the component. Referring to FIG. 3C, when a smaller or separated inner spaces are desired to accommodate small-sized components, users can fold the shock-absorbing rib 320 outward by applying force along the cut b to define a space S2, a space S3, and a space S4 in the frame 300. However, in such situation, a relative smaller shock-absorbing distance D2 is resulted as shown in FIG. 3C.

In the above embodiment, the shock-absorbing rib 320 is rectangular in shape. The two cuts a and b are perpendicular to the extending direction of the shock absorbing rib 320 and divide the shock-absorbing rib 320 into a plurality of divided portions.

Figure 4A:
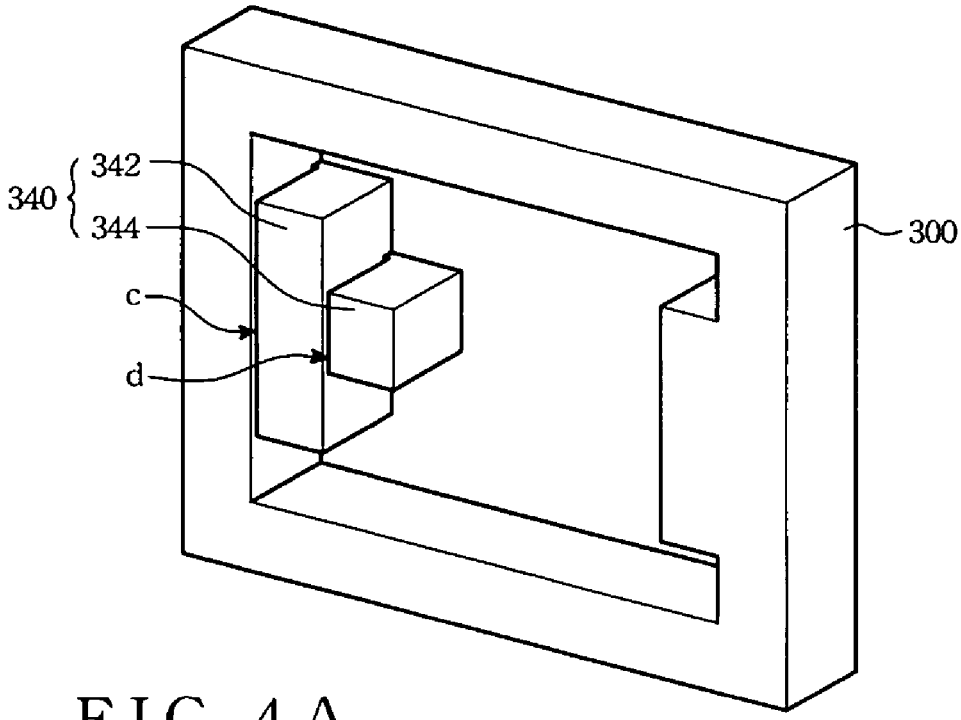
FIG. 4A is a schematic view depicting a second preferred embodiment of the shock-absorbing package structure in accordance with the present invention with a ladder-shaped shock-absorbing rib.
Figure 4B:
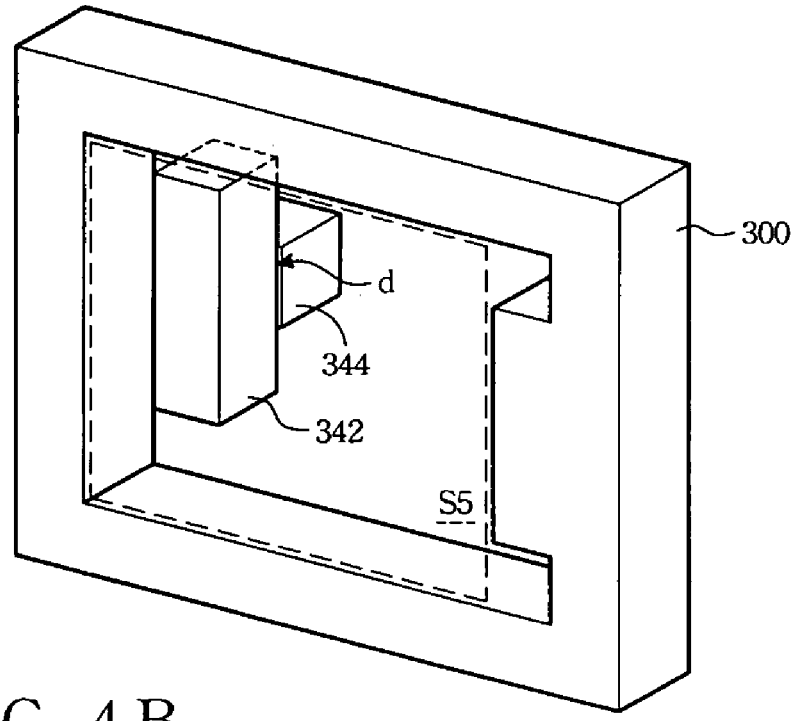
FIG. 4B is a schematic view depicting the shock-absorbing package structure of FIG. 4A, as the shock-absorbing rib c has been folded.
Figure 4C:
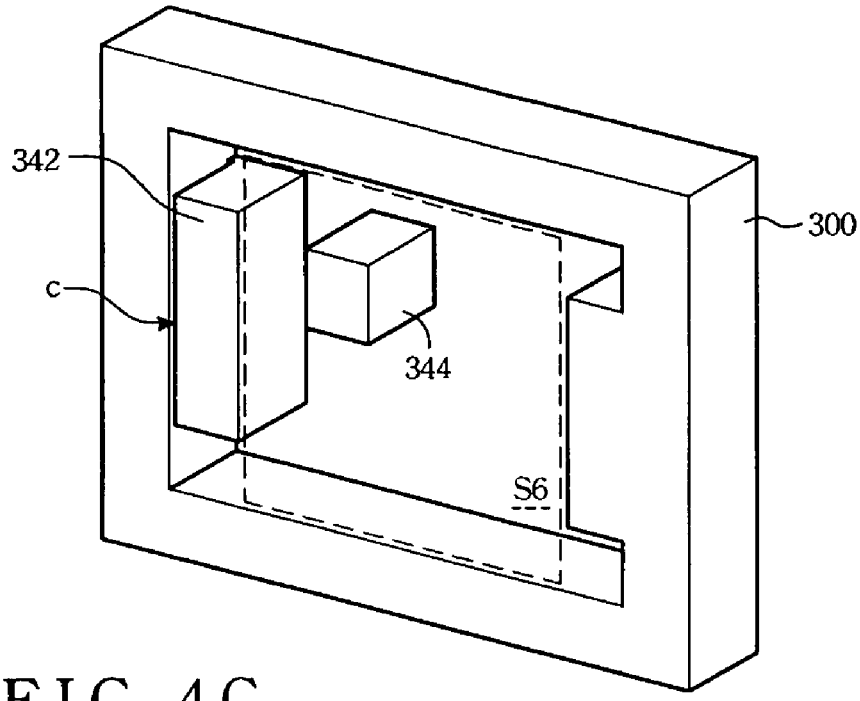
FIG. 4C is a schematic view depicting the shock-absorbing package structure of FIG. 4A, as the shock-absorbing rib d has been folded.

It is understood that by folding the shock-absorbing rib 340 along the cut c or d, respectively, different inner spaces are formed in the frame to meet the need. Referring to FIG. 4B, as the shock-absorbing rib 340 is bent along the cut c, a largest inner space S5 is provided. As shown in FIG. 4C, as the rectangle 344 is bent along the cut d (also referring to FIG. 4B) with respect to the rectangle 342, a smaller inner space S6 shown by the dotted line is formed to accommodate a smaller component.

Figure 5A:
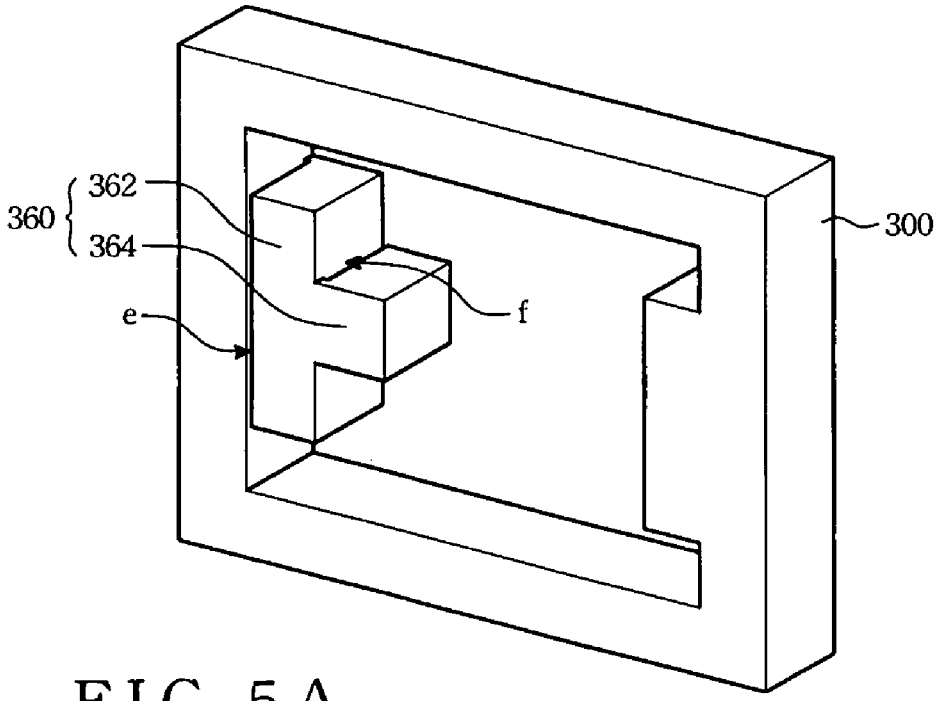
FIG. 5A is a schematic view depicting a third preferred embodiment of the shock-absorbing package structure in accordance with the present invention with two cuts formed with opposing cutting directions on the shock-absorbing rib.

In the above embodiments . . . the shock-absorbing rib 340 bent toward the same direction. That is, the divided portions on the shock absorbing rib 320, 340 and the frame 300 divided by the cuts, a, b, c, and d are connected with two connecting portions, respectively, and the connecting portions are located on an identical side of the shock-absorbing rib 320, 340. However, the present invention does not tend to limit the cutting directions of different cuts to a single one. That is, each cuts may has its own cutting direction according to the need. FIG. 5A shows a third preferred embodiment of the shock-absorbing package structure in accordance with the present invention. The cut e and cut f on the shock-absorbing rib 360 are formed with opposite cutting directions. That is, the divided portions on the shock absorbing rib 360 and the frame 300 are connected with two connecting portions, respectively, and the connecting portions are located on opposite sides of the shock-absorbing rib 360. In other words, the whole shock-absorbing rib 360 may be bent toward the back of the frame 300 when folding along the cut e, but the rectangle 364 will be bent toward the front of the frame 300 when folding along the cut f.

Figure 5B:
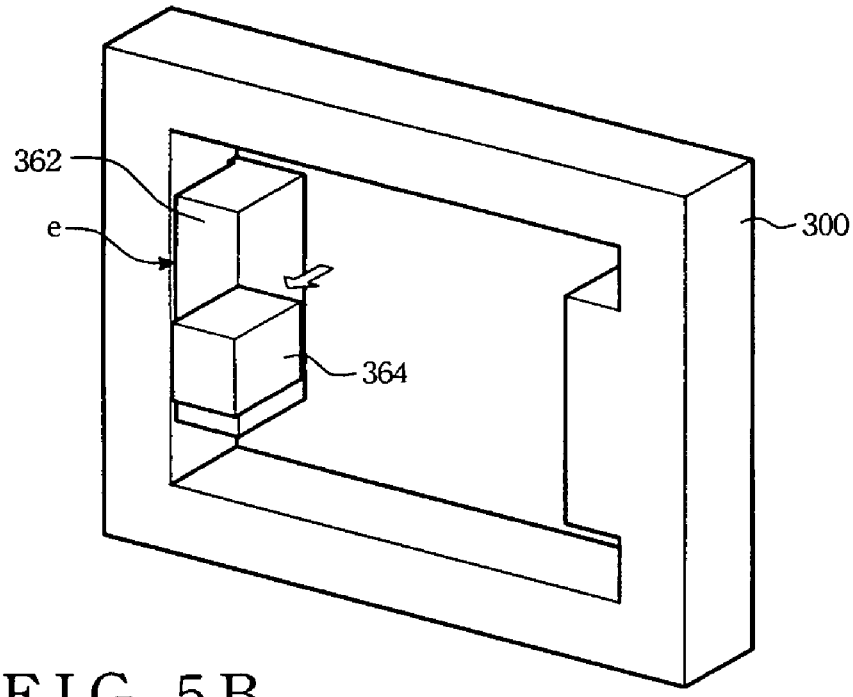
FIG. 5B is a schematic view depicting the shock-absorbing package structure of FIG. 5A, as the shock-absorbing rib f has been folded.

Referring to FIG. 5B, as the rectangle 364 is bent or folded along the cut f for fixing a component into the shock-absorbing package structure, the opposite cutting directions of the cuts e and f (also referring to FIG. 5A) can avoid simultaneously dragging of the rectangle 362 between the cuts e and f when the component is pushed into the frame 300, which might smoothen the package procedure.

Figure 6A:
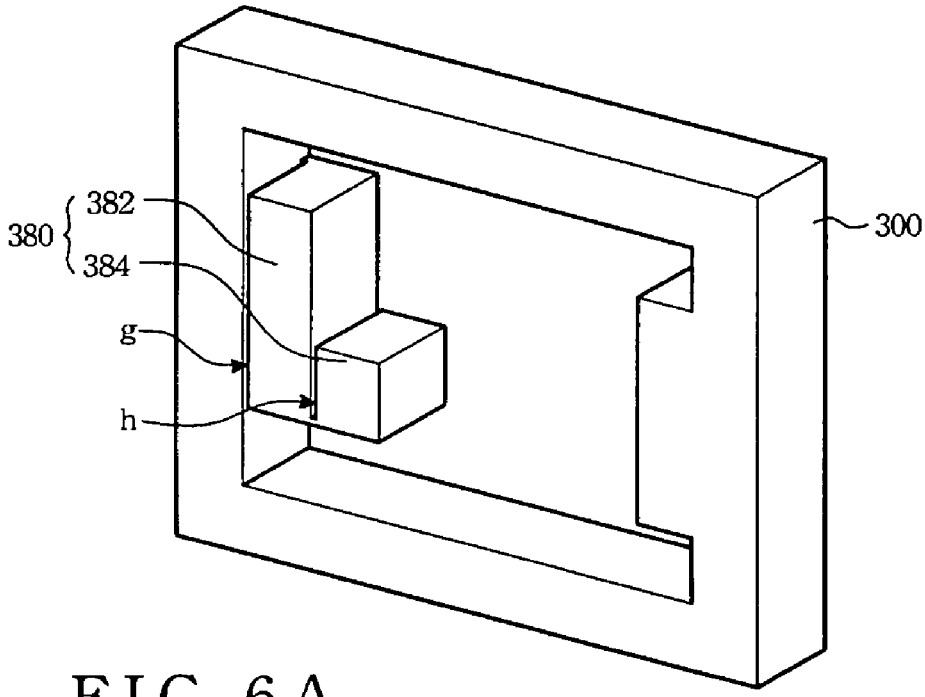
FIG. 6A is a schematic view depicting a forth preferred embodiment of the shock-absorbing package structure in accordance with the present invention with two cuts formed with cutting directions vertical to each other on the shock-absorbing rib.
Figure 6B:
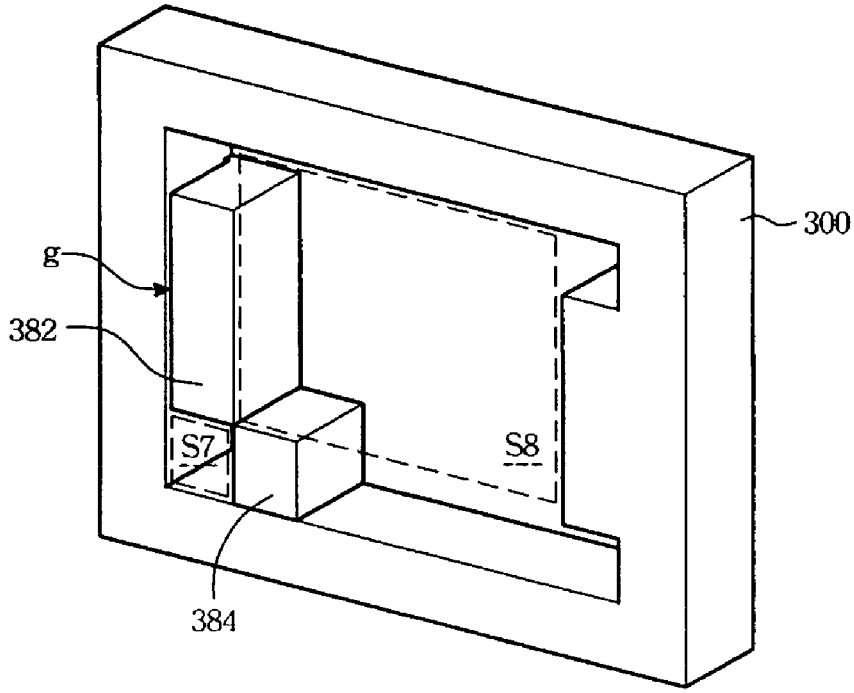
FIG. 6B is a schematic view depicting the shock-absorbing package structure of FIG. 6A, as the shock-absorbing rib h has been folded.

In addition, as shown in FIG. 6A, the two cuts g and h on the shock-absorbing rib 380 may be formed with two perpendicular cutting directions respectively for varying the shape of the inner space to match the components with different shapes and dimensions. That is, the divided portion on the shock absorbing rib 380 and the frame 300 are connected with two connecting portions, respectively, and the connecting portions are located on two different sides perpendicular to each other of the shock-absorbing rib 380. The shock-absorbing rib 380 may be bent toward the back of the frame 300 shown in FIG. 6A when folding along the cut g to define and largest inner space (not shown). Whereas the folding along the cut h may lead to small spaces S7 and S8 are separately defined in the inner space of the frame 300 as shown in FIG. 6B.

Figure 7:
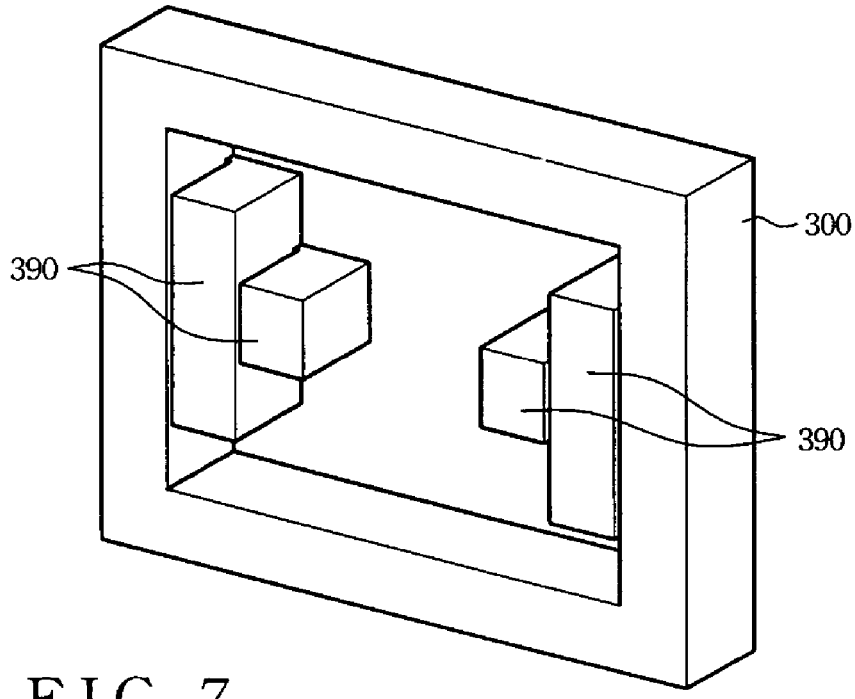
FIG. 7 is a schematic view depicting the shock-absorbing package structure in accordance with the present invention having two shock-absorbing ribs.

Although only a single shock-absorbing rib of the above embodiments are described, for the person skilled in the art, it is understood that the number of the shock-absorbing rib is not a limitation. FIG. 7 shows a fourth preferred embodiment of the shock-absorbing package structure having two shock-absorbing ribs 390. These two shock-absorbing ribs 390 are provided on the opposite sides of the frame 300, respectively. By folding the two shock-absorbing package structure for protecting the component enclosed in the shock-absorbing package structure.

Generally speaking, for a sufficient shock-absorbing protection, the composed materials of the shock-absorbing package structure can be chosen from resilient polystyrene plastic (EPS) material, generally called Styrofoam, or expanded polythene, generally called EPE. Of the two package materials, EPE is a better choice because of a greater strength to make shock-absorbing ribs foldable.

Compared with the traditional shock-absorbing package structures, the advantage of the shock-absorbing package structure in accordance with the present invention are described as follows.

Firstly, the shock-absorbing distance of the shock-absorbing package structure in accordance with the present invention can be adjusted to meet the needs of sufficient and effective shock-absorbing protection.

Secondly, the dimension and shape of the inner space can be adjusted by folding the shock-absorbing rib. Thereby, the shock-absorbing package structure in accordance with the present invention can be used to pack a variety of components with different dimensions and also accommodate some small-sized components.

Thirdly, because the shock-absorbing package structure in accordance with the present invention can be used to accommodate components with various dimensions, the types of the shock-absorbing package structures can be simplified.

That is, the investment of molding apparatus for producing these shock-absorbing package structures can be decreased.

Fourthly, the thickness of the shock-absorbing package structure in accordance with the present invention equals to the thickness of a single piece of shock-absorbing board by flattening the shock-absorbing rib. That is, the required space for storing the shock-absorbing package structure in accordance with the present invention is smaller.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

I claim:

1. A shock-absorbing package structure comprising:

a frame, forming an inner space therein to accommodate a component; and a shock-absorbing rib, extending from the frame into the inner space in an extending direction, the shock-absorbing rib having two cuts perpendicular to the extending direction of the shock-absorbing rib and dividing the shock-absorbing rib into a plurality of divided portions for folding the shock-absorbing rib;

wherein the divided portions and the frame are connected with two connecting portions, respectively, and the connecting portions are located on an identical side of the shock-absorbing rib, whereby the shape and dimension of the inner space can be adjusted according to the dimension of the component.

2. The shock-absorbing package structure according to claim 1, wherein one of the cuts is located at a root of the shock-absorbing rib.

3. The shock-absorbing package structure according to claim 1, wherein the shock-absorbing rib is made from foamed polystyrene (EPS) material.

4. The shock-absorbing package structure according to claim 1, wherein the shock-absorbing rib is made from expanded polythene (EPE) material.

5. The shock-absorbing package structure according to claim 1, wherein the shock-absorbing rib is made from expanded polythene (EPE) material.

6. A shock-absorbing package structure comprising:

a frame, forming an inner space therein to accommodate a component; and a shock-absorbing rib, extending from the frame into the inner space in extending direction, the shock-absorbing rib having two cuts perpendicular to the extending direction of the shock-absorbing rib and dividing the shock-absorbing rib into a plurality of divided portions for folding the shock-absorbing rib;

wherein the divided portions and the frame are connected with two connecting portions, respectively, and the connecting portions are located on opposing sides of the shock-absorbing rib, whereby the shape and dimension of the inner space can be adjusted according to the dimension of the component.

7. The shock-absorbing package structure according to claim 6, wherein on of the cuts is located at a root of the shock-absorbing rib.

8. The shock-absorbing package structure according to claim 6, wherein the shock-absorbing rib is made from foamed polystyrene (EPS) material.

9. The shock-absorbing package structure according to claim 6, wherein the shock-absorbing rib is made from expanded polythene (EPE) material.

10. A shock-absorbing package structure comprising:

a frame, forming an inner space therein to accommodate a component; and a shock-absorbing rib, extending from the frame into the inner space in an extending direction, the shock-absorbing rib having two cuts perpendicular to the extending direction of the shock-absorbing rib and dividing the shock-absorbing rib into a plurality of divided portions for folding the shock-absorbing rib;

wherein the divided portions and the frame are connected with two connecting portions, respectively, and the connecting portions are located on two different sides perpendicular to each other of the shock-absorbing rib, whereby the shape and dimension of the inner space can be adjusted according to the dimension of the component.

11. The shock-absorbing package structure according to claim 10, wherein one of the cuts is located at a root of the shock-absorbing rib.

12. The shock-absorbing package structure according to claim 10, wherein the shock-absorbing rib is made from foamed polystyrene (EPS) material.

13. A shock-absorbing package structure comprising:

(a) a frame comprising an inner space to accommodate a component; and (b) a shock-absorbing rib extending from a first side of the frame into the inner space; said shock-absorbing rib comprising first and second cut means for dividing the rib into first and second divided portions such that (a) the first portion of the shock-absorbing rib has a first portion side with only a part of the first portion side forming a first foldable connecting portion connecting the first portion to the first side of the frame whereby the first portion is foldable about the first foldable connecting portion into any of a plurality of positions with respect to the frame including a first position with the first portion side facing the first side of the frame and a second position with the first portion side facing in a different direction, and (b) the second portion of the shock-absorbing rib has a second portion side with only a part of the second portion side forming a second foldable connecting portion connecting the second portion to the first portion, whereby the second portion is foldable about the second foldable connecting portion into any of a plurality of positions with respect to the first portion including a first position with the second portion side facing the first portion and a second position with the second portion side facing in a different direction, wherein the first foldable connecting portion and the second foldable connecting portion are in a disposition with respect to one another selected from the group consisting of: (i) on a same side of the shock-absorbing rib; (ii) on opposing sides of the shock-absorbing rib; and (iii) perpendicular to each other on different sides of the shock absorbing rib.

14. A method for packaging a component, comprising:

(a) providing the shock-absorbing package of claim 13; and (b) adjusting a dimension of the inner space of the frame by folding at least one of the first portion and the second portion of the shock-absorbing rib into a desired position to accommodate the component. shock-absorbing rib into a desired position to accommodate the component.

* * * * *